United States Patent [19]

Dean, II

[11] Patent Number: 4,516,507

[45] Date of Patent: May 14, 1985

[54] MECHANICAL STOP MECHANISM FOR A TILT SYSTEM IN A RAILWAY CAR

[75] Inventor: Walter C. Dean, II, Collegeville, Pa.

[73] Assignee: The Budd Company, Troy, Mich.

[21] Appl. No.: 410,235

[22] Filed: Aug. 23, 1982

[51] Int. Cl.[3] ..... B61F 3/08

[52] U.S. Cl. ..... 105/199 A; 105/164

[58] Field of Search ..... 105/199 A, 199 R, 164, 105/210, 453, 182 R; 188/265; 267/139

[56] References Cited

U.S. PATENT DOCUMENTS 3,874,747 4/1975 Case et al. ..... 188/265 X
4,007,815 2/1977 Acre ..... 188/265
4,228,741 10/1980 Bruner ..... 105/199 R X
4,355,582 10/1982 Germer ..... 105/199 A X

*Primary Examiner*—Robert B. Reeves
*Assistant Examiner*—Glenn B. Foster
*Attorney, Agent, or Firm*—Edward M. Farrell; Herman Foster; Thomas I. Davenport

[57] ABSTRACT

A tilt system for a railway car includes mechanical actuating members for tilting the car only when lateral acceleration forces exceed preselected minimum levels. A mechanical stop mechanism is provided to selectively permit the tilting operation to exceed non-tilt stop positions.

1 Claim, 5 Drawing Figures

MECHANICAL STOP MECHANISM FOR A TILT SYSTEM IN A RAILWAY CAR

BACKGOUND OF THE INVENTION

It is well known that when railway cars go around curves at relatively high speeds that lateral forces are produced in the car which cause passenger discomfort. Generally higher speeds are possible if the car body is tilted to reduce the lateral curving accelerations experienced by the passengers.

There have been many types of tilt methods proposed and some in service. These methods can be catagorized as proportional systems, both passive and active. In a passive system, the car body is suspended at a point above the center of gravity. The body then tilts into the curve in response to a lateral acceleration. This system may require a portion of the tilt mechanism to be within the passenger compartment, and therefore, reduces the revenue seats available and results in considerable increase in car structure.

In the active type control, the car body tilt would constantly be adjusted to minimize the effect of lateral acceleration on the passengers. The car body would tilt in such a way that the passengers would barely detect that they werein a curve until the tilt system has reached its maximum angle. If the car exceeds this balance speed, the excess speed will be felt as a lateral acceleration. Normally, an excess speed equivalent to 3 inches cant deficiency (0.05 g's) is acceptable. This system requires a considerable amount of feedback signal processing and control.

Stop members are generally used to limit suspension travel vertically and in roll during non-tilt operation. These stop members must be selectively repositioned to permit tilting of the car body, dependent upon the operating condition. U.S. patent entitled "Railway Car Tilt Control System", U.S. Pat. No. 4,355,582, issued Oct. 26, 1982.

In the aforementioned Patent in FIGS. 8 and 11, there is described stop mechanisms which must be selectively operated before the tilting of the car can take place. While the stop arrangements described are satisfactory in most respects, they do require a somewhat complicated hydraulic system which adds to the complexity and costs of the system. The present invention is directed towards improvements in the stop mechanisms in a tilting system of the type described in the above patent.

OBJECTS OF THE INVENTION

It is an object of this invention to provide an improved mechanical stop mechanism for a tilting system in a railway car.

It is a further object of this invention to provide an improved mechanical stop mechanism which is relatively simple and does not require a complex hydraulic arrangement.

BRIEF SUMMARY OF THE INVENTION

In accordance with the present invention, a pair of stop mechanisms is connected between the truck and to both sides of a car body of a railway car. Each of the mechanisms include a shaft member disposed in a housing to limit downward movement or tilting of the car body. A spring loaded block element normally extends into the housing below the shaft member to prevent downward movement thereof. A movable piston is connected to the block element. Means are employed to selectively apply pressure to move the piston against the bias of the spring to cause the block element to be retracted to permit downward movement of the shaft member.

Other objects and advantages of the present invention will be apparent and suggest themselves to those skilled in the art, from a reading of the following specification and claims taken in conjunction with the accompanying drawings.

DETAILED DESCRIPTION OF THE INVENTION

Figure 1:
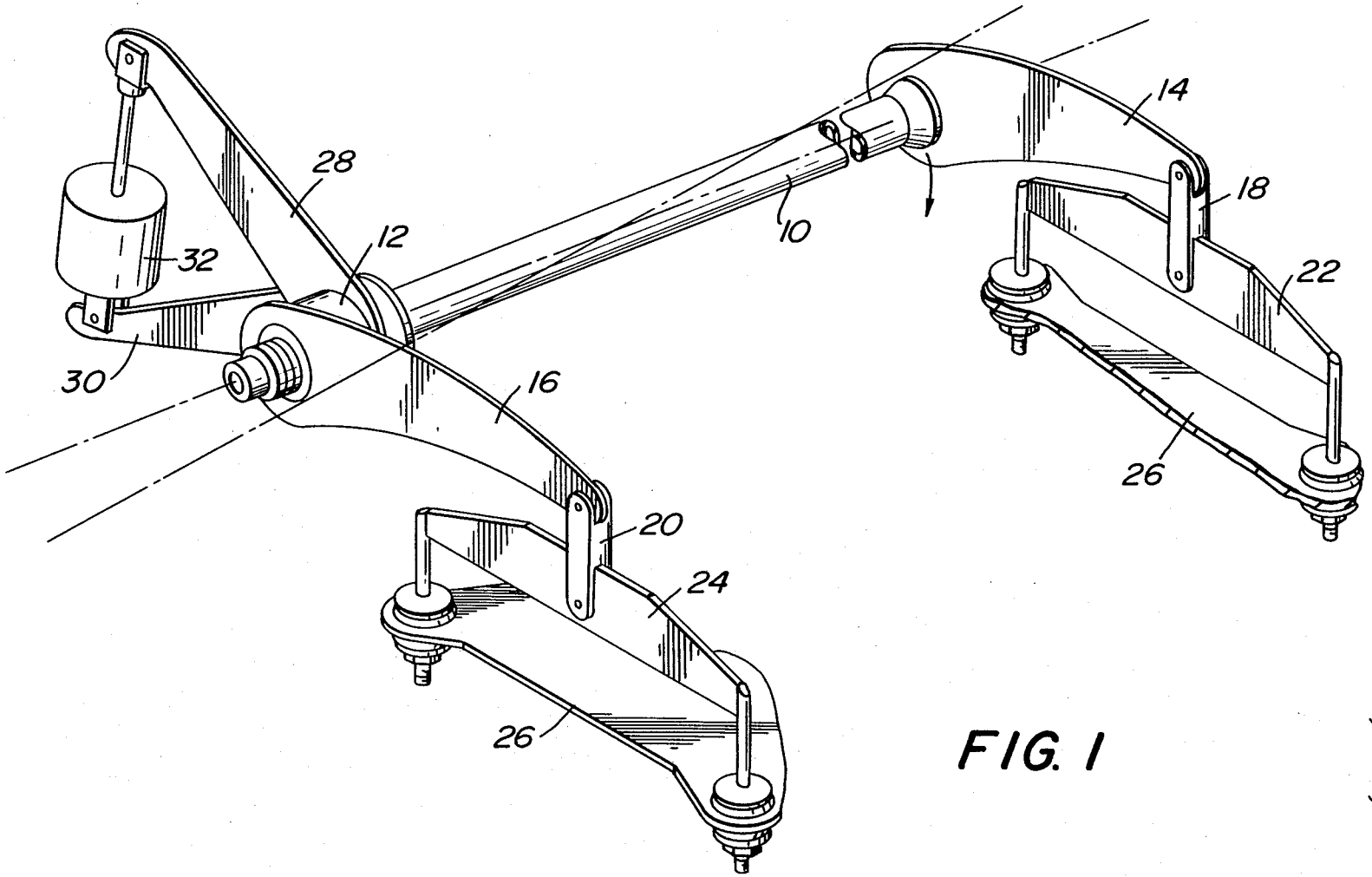
FIG. 1 is an isometric view illustrating one type of tilting system with which the present invention may be used.

Referring to FIG. 1, a tilting system of the type described in the aforementioned application, includes members 10 and 12 which are secured to rotate in brackets (not illustrated) which are fixably mounted to a car body. The ends of the rotatable members 10 and 12 are free to rotate within the brackets.

The ends of the members 10 and 12 are connected to lever arms 14 and 16, respectively. The lever arms 14 and 16 are adapted to move or be pivoted with the ends of the rotatable members 10 and 12 during a tilting operation. The other ends of the lever arms 14 and 16 are connected to a pair of links 18 and 20, respectively. The links 18 and 20 are pivotally connected between the lever arms 14 and 16 and steel plates 22 and 24. The steel plates are fixedly secured to the bolster 26 of the truck by means of suitable mounting means. Because the steel plate 24 is fixed to the bolster 26, the link 20 may in effect be considered as being connected directly to the bolster 26. This is also true of the link 18. Consequently, when the lever arms 14 and 16 are rotated, one end of the lever arms will tend to stay fixed with respect to the car body and the other end will tend to move up or down, depending upon the tilting direction, to transmit force through the links 18 and 20 to force the car body up or down with respect to the bolster 26. The system is designed to move the lever arms 14 and 16 in opposite directions so that the associated links 18 and 20 will tend to permit the sides of the car to be tilted up or down in opposite directions.

A pair of arms 28 and 30 are fixedly secured to the members 10 and 12, respectively, with the detailed connections not being illustrated. The rotatable member 10 is connected to be rotated by the arm 30 and the rotatable member 12 is connected to be rotated by the arm 28.

Figure 3:
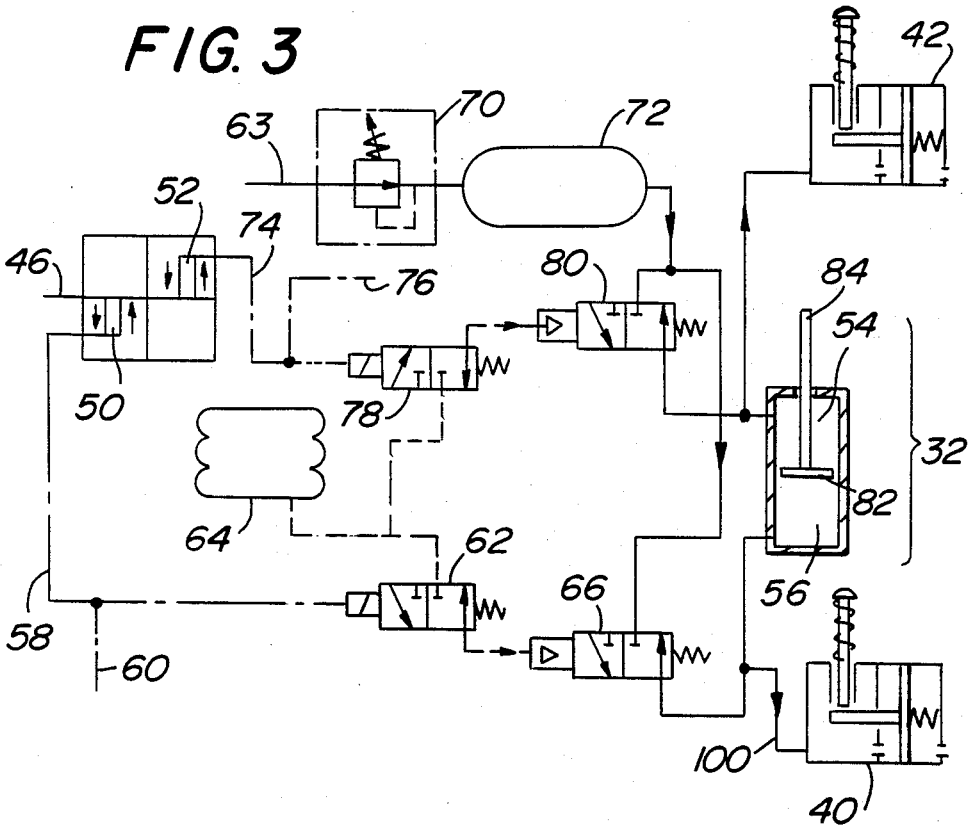
FIG. 3 illustrates a typical system which may be used to actuate the stop mechanisms, in accordance with the present invention.

An actuator 32 is connected between the free ends of the arms 30 and 28. The actuator 32 is disposed to spread the arms 28 and 30 or to bring them closer together. Details of the actuator 32 and its activation source are shown in FIG. 3.

Figure 2:
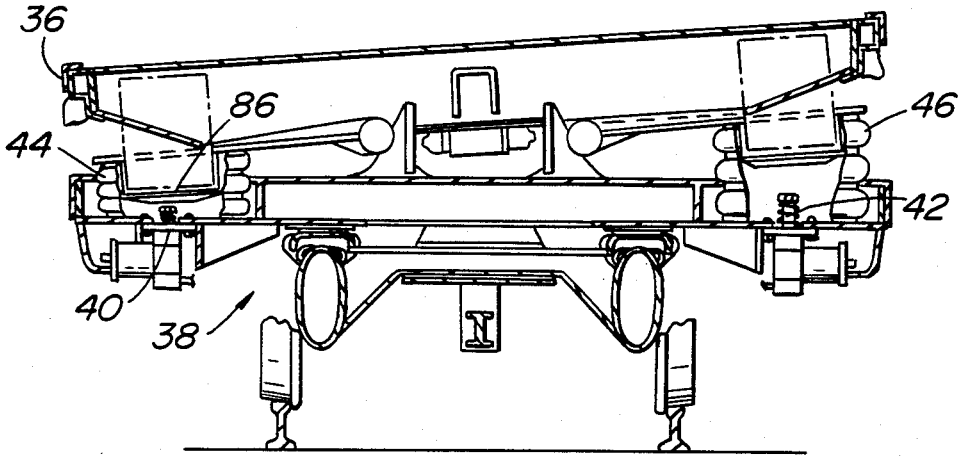
FIG. 2 is a cross-sectional view of a typical railway car on a truck, shown primarily to illustrate the stop mechanisms, in accordance with the present invention.

Referring to FIG. 2, a view of the car body 36 and truck 38 which may incorporate the down stop members 40 and 42 which relate to the present invention to be described in detail. The member 40 is illustrated in a down position to permit the left side of the car body 36 to be tilted downwardly. The member 42 is maintanined in a fixed position. One of the down stop members 40 or 42 is effectively repositioned within the system dependent upon the direction of tilting. During a non-tilt operation, both the down stop members 40 and 42 are fixed and they act as conventional down stop members found in many sytems. When the car is moving with no tilting, the down stop members 40 and 42 are both in fixed upper positions.

Air springs 44 and 46 support the car body 36. These air springs will normally operate in a conventional manner when no tilting is involved and continue to support the car when tilting occurs.

Various other details relating to the car body and truck will not be described in detail because they are well known and not related to the present invention.

Referring to FIG. 3, a typical system for activating actuator 32 of FIG. 1 is illustrated. Basically, the system is designed to provide tilting of a car body in either direction when the lateral acceleration forces exceed some predetermined level. Tilting of the car body is then executed to a predetermined number of degrees.

The lateral acceleration forces are preferably detected on the truck below the car body. The accelerometer sends a signal to a controller 46 which applies electrical power to pilot solenoid valves 62 or 78 through switches 50 or 52 respectively when the acceleration measured reaches some predetermined level such as 0.04 g's, and removes power when the acceleration subsequently decreases to some lower value such as 0.03 g's. The selection of switch 50 or 52 depends on the direction of the acceleration such that the car will tilt in the appropriate direction to reduce the lateral g level in the car body.

Depending upon which of the switches 50 or 52 is actuated, the car body 36 (FIG. 2) will be tilted in one direction or the other by the application of pressure to an upper chamber 54 or lower chamber 56 of the actuator 32, as will be described. First a situation in which the switch 50 is actuated.

When the switch 50 is actuated, an electrical signal is developed at a line 58, which is also applied to a line 60 connected to a corresponding valve and actuator arrangement in the trailing truck. The signal at the line 58 is applied to a valve 62 to open the valve to permit pressurized pilot air to pass from air spring or reservoir 64, through the valve 62 to a valve 66.

Figure 4:
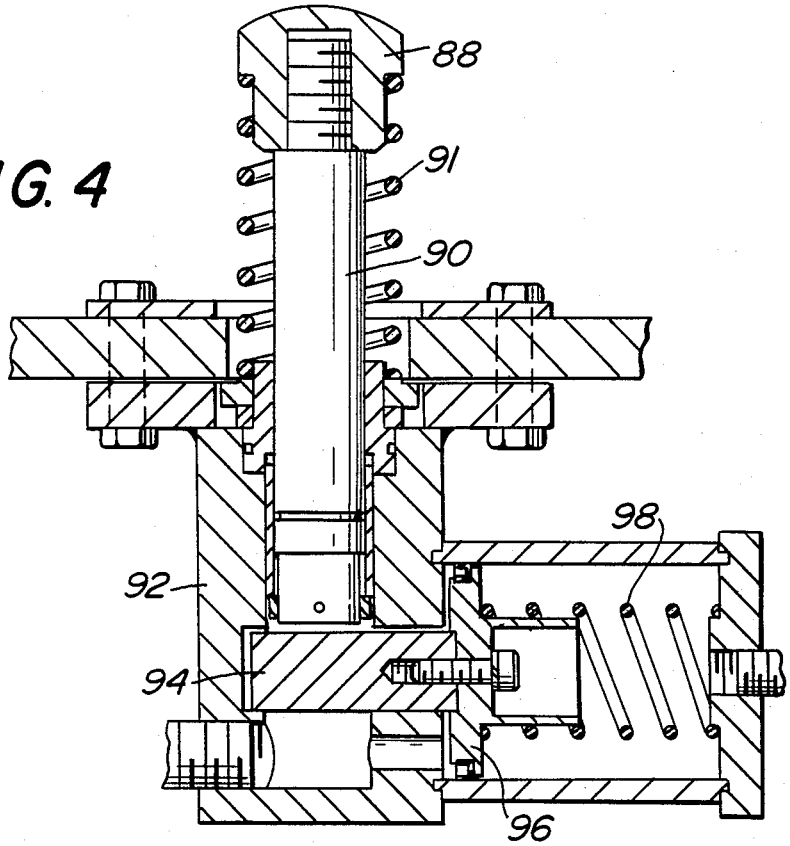
FIG. 4 is a cross-sectional view illustrating one of the stop mechanisms of the present invention positioned to prevent tilting of the railway car.
Figure 5:
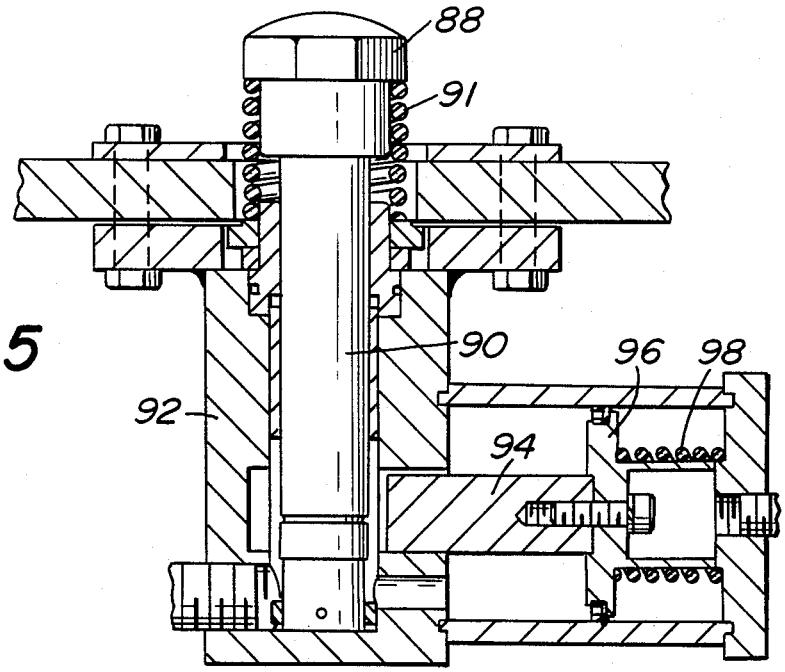
FIG. 5 is a cross-sectional view similar to FIG. 4 illustrating the stop mechanism positioned to permit tilting of the car body.

A main reservoir in the system (not illustrated) is connected to valve 66 from a line 63 through a pressure regulator 70 to a reservoir 62 which may be disposed at each end of the car. Pressure in the reservoir 62 is sufficient to provide the forces necessary for tilting the car body. When the valve 66 is actuated or opened, air pressure from the reservoir 72 passes through the valve 66 to the bottom chamber 56 of the actuator 32. This causes the arms to which the actuator 32 (FIG. 1) is connected to expand to cause tilting of the car in one direction as described in connection with FIGS. 3 and 4.

When the car body has to be tilted in the opposite direction, the switch 52 is actuated to produce an electrical signal at the line 74 as well as the line 76 which is connected to the trailing truck valves and actuator. A typical signal at the line 74 opens a valve 78 to permit pilot air pressure from the reservoir or air spring 64 to pass therethrough to a valve 80. The air pressure applied to the valve 80 causes it to open to permit air pressure from the reservoir 72 to pass therethrough into the upper chamber 54 of the actuator 32. This causes the arms described in connection with FIG. 1 to contract thereby causing the car to tilt in the opposite direction to that previously described as when the valve 66 was actuated.

Depending upon whether the pressure is applied to the upper or lower chamber 54 or 56, the piston 82 will move up or down. This causes the arm 84 to move up or down. The actuator connected between the lever arms illustrated in FIG. 1 will in effect become longer or shorter depending upon the application of the pressure. This expansion or contraction of the actuator 32 causes tilting of the car in the manner previously described.

The system described in connection with FIG. 3 thus far is similar to the system described in the aforementioned application. The operation of the stop mechanisms 40 and 42 to which the present invention is related, is different and does not require hydraulic means.

Both of the stop mechanisms are similar in design. Therefore only the mechanism 40 will be described in detail, it being understood that the operation of the mechanism 42 is similar for a tilting operation taking place in the opposite direction.

In a normal untilted operation, the spring plank 86 (FIG. 2) will contact a cap 88 (FIG. 4) which may be threaded to the end of the shaft 90, normally biased upward by a spring 91 disposed in a main housing 92. A block element 94 is disposed within the housing 92 to normally limit the downward movement of the shaft 90 and consequently the car body 36 (FIG. 2). The block element is attached to a piston 96 which is biased forwardly by a spring 98 which maintains the block 94 normally in the forward position.

When the car is to be tilted, air pressure is applied from the valve 66 through a line 100 into the housing 92. The air pressure forces the piston 96 to move against the bias of the spring 98 causing it to retract the block 94. This moves the block 94 out of the way of the shaft 90 to permit it to bottom in the central hole of the housing 92 as the spring plank 86 moves down. This permits tilting. When there is no pressure in the line 100, the spring 98 forces the piston 96 and block 94 back to their original positions once the spring 91 has returned the shaft 90 to its fully extended position as the spring plank 86 moves up.

What is claimed is:

1. In combination with a tilting system for a railway car body disposed on a truck, a pair of stop mechanisms connected to said truck to limit tilting of said car, each of said stop mechanisms being disposed towards opposite sides of said car body and comprising:

(a) a main housing for each of said pair of stop mechanisms:

(b) a shaft member disposed in said housing for engaging the bottom portion of said car to limit the downward movement of said car body;

(c) a movable block element extending below and in contact with said shaft member;

(d) a piston connected to said movable block element;

(e) biasing spring means normally biasing said block element in an extended position below said shaft member to prevent downward movement of said shaft member; and (f) means for selectively applying pressure to move said piston to overcome the bias of said biasing means to cause said block element to be retracted from a position below said shaft member to permit free downward movement of said shaft member thereby permitting tilting of said car, and (g) a second spring connected to bias said shaft member normally upwardly to continuously engage the bottom portion of said car body.

* * * * *